United States Patent [19]

Vera et al.

[11] Patent Number: 4,915,583

[45] Date of Patent: Apr. 10, 1990

[54] RADIAL-FLOW FAN IN PARTICULAR FOR THE AIR-CONDITIONING OF A MOTOR VEHICLE

[75] Inventors: Jean C. Vera, Valentigney; Maurice Bertot, Luxeuil Les Bains, both of France

[73] Assignee: Aciers Et Outillage Peugeot, Audincourt, France

[21] Appl. No.: 26,803

[22] Filed: Mar. 17, 1987

[30] Foreign Application Priority Data

Mar. 17, 1986 [FR] France ..... 86 03742

[51] Int. Cl.[4] ..... F04D 29/54

[52] U.S. Cl. ..... 415/206; 415/204; 416/185

[58] Field of Search ..... 415/203, 204, 206, 212 R, 415/213 R, 213 A, 213 B, 219 R, 219 L; 416/179, 180, 185, 193 R, 193 A, 214 R, 214 A

[56] References Cited

U.S. PATENT DOCUMENTS

| | | | |
|---|---|---|---|
| 1,665,458 | 4/1928 | Hollander | 416/185 |
| 2,126,230 | 8/1938 | Troxell | 416/179 |
| 3,130,679 | 4/1964 | Sence | 415/204 |
| 3,344,766 | 10/1967 | Cottell | 415/204 |
| 3,627,440 | 12/1971 | Wood | 415/204 |
| 3,771,925 | 11/1973 | Friberg | 416/185 |
| 4,594,052 | 6/1986 | Niskanen | 416/185 |

FOREIGN PATENT DOCUMENTS

| | | |
|---|---|---|
| 1503607 | 1/1969 | Fed. Rep. of Germany . |
| 2927147 | 1/1981 | Fed. Rep. of Germany . |
| 863235 | 3/1941 | France . |
| 516743 | 1/1972 | Switzerland . |
| 796696 | 6/1958 | United Kingdom . |

*Primary Examiner*—Harry B. Tanner

*Attorney, Agent, or Firm*—Sughrue, Mion, Zinn, Macpeak & Seas

[57] ABSTRACT

The fan comprises a volute housing (10) in which is disposed a ventilation wheel (11) connected to a driving motor (12). The wheel has a series of vanes (13) extending in a direction roughly parallel to the axis of rotation (X—X) of the wheel from a bowl (14) connecting the vanes to the driving motor to an edge portion (15) of an air intake (16) defining with the bowl a space for a fluid stream. The confronting surfaces of the bowl and the edge portion of the air intake, at least to the inner edges of the vanes, are generated by rotation of parallel sections of curves about the axis of rotation (X—X).

14 Claims, 3 Drawing Sheets

RADIAL-FLOW FAN IN PARTICULAR FOR THE AIR-CONDITIONING OF A MOTOR VEHICLE

BACKGROUND OF THE INVENTION

The present invention relates to a radial flow fan, in particular for the air-conditioning of a motor vehicle.

A number of fans of this type are known in the art.

Thus, for example, the Pat. No. FR-2 471 503 discloses a radial-flow fan comprising a volute housing in which is disposed a ventilation wheel connected to driving means. The wheel has a series of vanes each having an outer edge and an inner edge and extending in a direction roughly parallel to the axis of rotation of this wheel, from a bowl connecting the vanes to the driving means, to an edge of an air intake defining with the bowl a space for a fluid stream.

All these devices have a number of drawbacks.

Indeed, as the efficiency of such fans is relatively low, the driving means are formed by two-pole electric motors whereby it is possible to drive the ventilation wheel at a relatively high speed of rotation to compensate for this low efficiency while retaining the same overall size. These two-pole motors have a relatively great axial length, which makes it necessary, in order to limit the total overall size of the fan, to use a greatly bulging impeller bowl. This results in a further drop in the efficiency of the unit.

Lastly, the efficiency of this type of motor is relatively low and it has a tendency to heat up so that it is necessary to provide a cooling device for this motor. An example of such a cooling device is described in the aforementioned patent.

SUMMARY OF THE INVENTION

An object of the invention is therefore to overcome the problems mentioned hereinbefore.

The invention therefore provides a radial-flow fan for in particular the air-conditioning of a motor vehicle, of the type defined hereinbefore, wherein the confronting surfaces of the bowl and the edge portion of the air intake, at least up to the inner edges of the vanes, are generated by the rotation about said axis of rotation of parallel sections of curves.

Advantageously, the parallel sections of curves are constituted by concentric arcs of circles.

According to an advantageous feature of the fan according to the invention, the driving means are formed by a four-pole electric motor whose axial length is less than the diameter.

BRIEF DESCRIPTION OF THE DRAWINGS

A better understanding of the invention will be had from the following description which is given solely by way of example with reference to the accompanying drawings, in which.

DETAILED DESCRIPTION OF PREFERRED EMBODIMENTS

Figure 1:
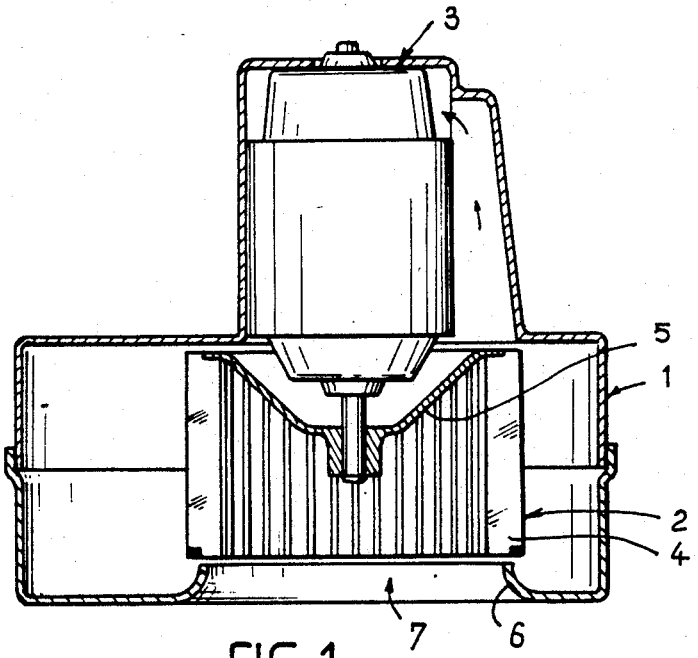
FIG. 1 (PRIOR ART)
FIG. 1 is a sectional view of a radial-flow fan of the prior art.

As can be seen in FIG. 1, a radial-flow fan of the prior art comprises a volute housing 1 in which is disposed a ventilation wheel 2 connected to driving means 3 constituted by an electric motor which is for example of two-pole type. The wheel 2 has a series of vanes 4 each having an outer edge and an inner edge and extending in a direction roughly parallel to the axis of rotation of the wheel from a bowl 5 connecting the vanes to the driving means 3, to an edge portion 6 of an air intake 7 defining with the bowl a space for a fluid stream.

As mentioned before, this fan has a number of drawbacks owing in particular to the size of the electric motor which requires the use of a greatly bulging bowl and consequently a smaller effective height of the vanes.

Figure 2:
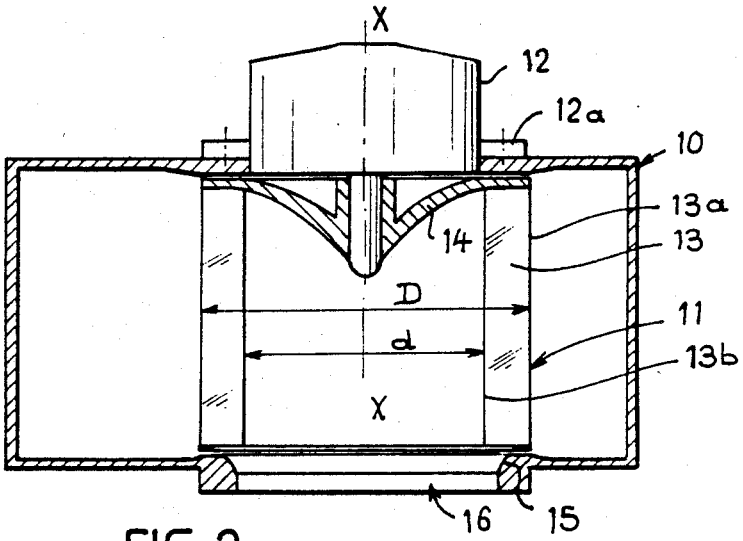
FIG. 2 is a sectional view of a fan according to the invention.

As can be seen in FIG. 2, a radial flow fan according to the invention also comprises a volute housing 10 in which is disposed a ventilation wheel 11 which is moulded or cast and connected to driving means 12 constituted by a four-pole electric motor whose axial length is less than its diameter. The use of this motor is made possible owing to the increase in the efficiency of the unit and in particular in the ventilation wheel whose structure will be described in more detail hereinafter. The motor 12 may be fixed to the housing 10 by portions **12*a* which project from each side of this motor. The wheel further comprises a number of vanes 13 each having an outer edge 13*a* defining a circle of diameter D, an inner edge 13*b*** defining a circle of diameter d.

These vanes extend in a direction roughly parallel to the axis of rotation X—X of the ventilation wheel from a bowl 14 connecting these vanes to the electric motor, to an edge portion 15 of an air intake 16 which defines with the bowl a space for a fluid stream. The confronting surfaces of the bowl and the edge portion of the air intake, at least up to the inner edges of the vanes, are generated by rotation about said axis of rotation of parallel sections of curves, and more particularly of concentric arcs of circles in the illustrated embodiment.

Figure 3:
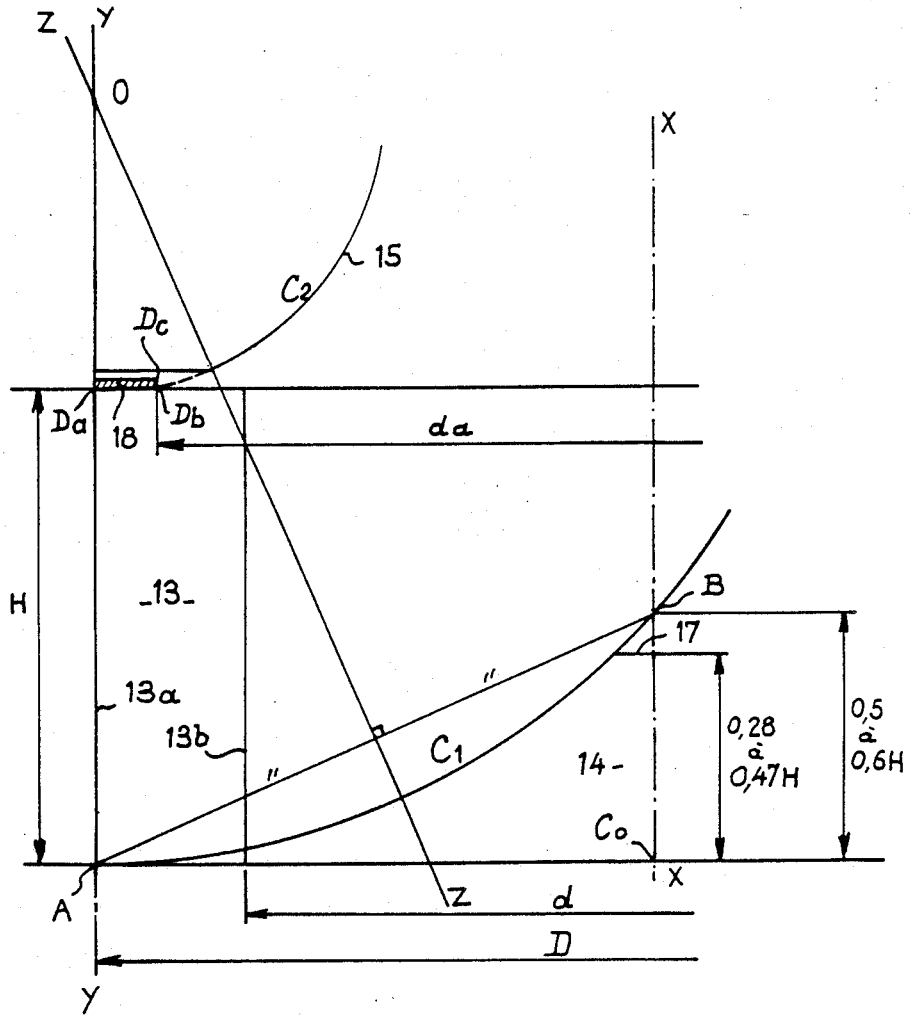
FIG. 3 is a partial view of a ventilation wheel which is part of the construction of a fan according to the invention.

As can be seen more clearly in FIG. 3, the height H of the vanes is less than or equal to D/2 in which D represents the diameter of the circle defined by the outer edges of the vanes. The center 0 of the circles C1 and C2 whose arcs define the confronting parts of the bowl 14 and the edge portion 15 of the air intake, is located at the point of intersection of a straight line Y—Y passing through the outer edge of a vane and the perpendicular bisector Z—Z of a straight line extending between the point of intersection A of said straight line Y—Y and a plane defined by the base of the bowl 14 and a point B located on the axis of rotation X—X of the ventilation wheel at a height between 0.5 and 0.6 times the height H of the vanes from said plane.

Note that the top of the bowl advantageously has a flat surface 17. The height of the top of the bowl, and therefore for example of this flat surface, is between 0.28 and 0.47 times the height H of the vanes from the plane defined by the base of the bowl.

Figure 4:
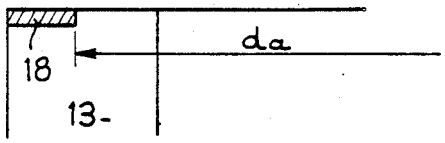
FIGS. 4, 5 and 6 are sectional views of details of the construction of the ventilation wheel shown in FIG. 3.

A stiffening ring 18 having an outer edge and an inner edge is provided at the free end of the vanes. As shown in FIG. 3, this stiffening ring may be disposed on top of the vanes. However, and as shown in FIG. 4, this stiffening ring may also be inserted between the vanes.

In either case, the outer edge of this stiffening ring defines a circle of diameter D and its inner edge defines a circle of diameter $da \geqq (D+d)/2$ : in which D is the diameter of the circle defined by the outer edges of the vanes and d is the diameter of the circle defined by the inner edges of the vanes.

The circle C2, whose arc defines the edge portion 15 of the air intake confronting the bowl, may pass through several points of this stiffening ring. Thus, for example, this circle may pass through a point Da on the outer edge of the stiffening ring 18 facing the base of the bowl.

However, and as shown in FIG. 3, this circle may also pass through a point Db on the inner edge of the stiffening ring facing the base of the bowl.

Lastly, this circle may also pass through a point Dc on the inner edge of the stiffening ring facing the edge portion 15 of the air intake.

Figure 5:
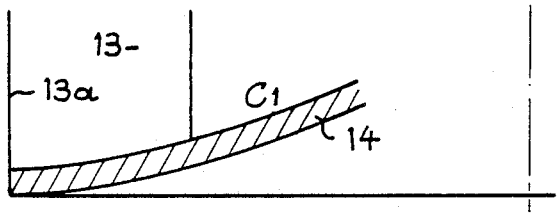

As can be seen in more detail in FIG. 5, the arc of a circle C1 defining the part of the bowl facing the corresponding part of the edge portion of the air intake may extend from the top of the bowl to the outer edges 13*a* of the vanes 13.

Figure 6:
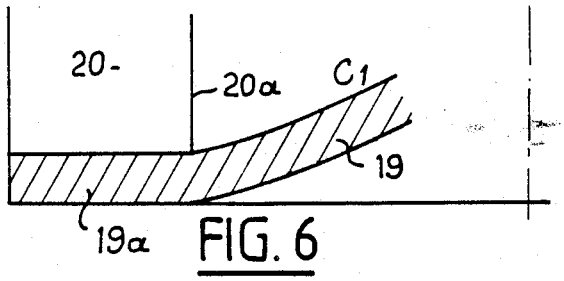

According to another embodiment shown in FIG. 6, the arc of a circle C1 defining this part of a bowl 19 facing the corresponding part of the edge portion of the air intake, extends from the top of the bowl to the inner edges 20*a* of vanes 20 and the bowl 19 has a peripheral portion 19*a* which is roughly parallel to the plane defined by the base of the bowl and on which the vanes 20 are fixed.

Returning to FIG. 2, it is clear that the inner walls of the housing 10 parallel to the base of the bowl 14 each have a portion whose thickness gradually decreases roughly from the outer edge of the vanes so as to avoid a detachment of the air streams leaving the ventilation wheel.

Also note that the stiffening ring advantageously has a rectangular section and a thickness determined in the known manner which may vary for example from 1 to 3 mm depending on the size of the ventilation wheel.

It will be understood that the confronting surfaces of the bowl and the edge portion of the air intake may be generated by rotation about the axis of rotation of other shapes of sections of a curve provided the latter are parallel so as to define a fluid stream whose section is constant around the axis of rotation of the ventilation wheel.

The use of a four-pole electric motor affords a number of advantages. Indeed, these motors have a relatively high efficiency and consequently heat up only to a slight extent so that it is no longer necessary to provide cooling devices. Further, these motors also have good stability as concerns possible fluctuations of the resisting torque pertaining to the ventilation wheel.

As the speed of rotation of the ventilation wheel is reduced owing to the increase in its efficiency, the noise produced by the ventilator unit is also reduced relative to ventilator units of the prior art.

This is relatively important in particular in respect of the clearance between the edge portion of the air intake and the corresponding portion of the ventilation wheel, since certain phenomena of recirculation of air through this space may occur when for example the discharge pressure increases upon increase in the pressure drops on the downstream side of the fan.

What is claimed is:

1. A radial-flow fan for the air conditioning of a motor vehicle, comprising:

a volute housing (10);

a ventilation wheel (11) disposed in said housing and rotatable about an axis (X—X);

driving means (12) connected to said ventilation wheel;

an air intake (16) with an intake edge (15) centered on said axis, said ventilation wheel including a plurality of axially extending vanes (13; 20) each having an outer edge (13*a*) and an inner edge (13*b*; 20*a*) and each extending in a direction substantially parallel to said axis; and a bowl (14; 19) connecting said vanes with said driving means and defining with said intake edge a space for a fluid flow, the outer edges (13*a*) of said vanes defining a first circle of diameter D, and the inner edges (13*b*; 20*a*) of said vanes defining a second circle of diameter d, both said first and second circles being centered on said axis so that each of said vanes has a constant radial width, each of said bowl (14; 19) and intake edge (15) having respective surfaces which are in confronting position and which are generated, at least to the vane inner edges (13*b*; 20*a*), only by rotation of sections of curves about said axis, and wherein the traces of said surfaces, in a meridian plane which passes by said axis, always are parallel curves.

2. A radial-flow fan according to claim 1, wherein the sections of curves are constituted by concentric arcs of circles; wherein the circles whose arcs define the confronting surfaces of the bowl and edge portion of the air intake have a center which is located at a point of intersection of a straight line passing through the outer edge of a vane and the perpendicular bisector of a straight line extending between a point of intersection of said straight line with a plane defined by a base of the bowl and a point located on said axis of rotation of said wheel, at an axial height between 0.5 and 0.6 times the axial height of the vanes from said plane; and wherein the axial height of the vanes is no more than D/2.

3. A fan according to claim 2, wherein the bowl has a top and a base and the axial height of the top of the bowl is between 0.28 and 0.47 times the axial height of the vanes from a plane defined by the base of the bowl.

4. A fan according to claim 3, wherein the bowl has a top defining a flat surface.

5. A fan according to claim 3, wherein the arc of the circle defining the surface of the bowl confronting the corresponding surface of the edge portion of the air intake extends from the top of the bowl to the outer edges of the vanes.

6. A fan according to claim 3, wherein the arc of the circle defining the surfaces of the bowl confronting the corresponding surface of the edge portion of the air intake extends from the top of the bowl to the inner edges of the vanes and the bowl has a base and a peripheral portion which is roughly parallel to a plane defined by the base of the bowl and on which the vanes are fixed.

7. A fan according to claim 2, further comprising a stiffening ring having an outer edge and an inner edge located at a free end of the vanes; wherein the inner edge of the stiffening ring defines a circle having a diameter da so that:

$$da \geqq (D+d)/2.$$

8. A fan according to claim 7, wherein the stiffening ring is disposed on top of the vanes.

9. A fan according to claim 7, wherein the stiffening ring is inserted between the vanes.

10. A fan according to claim 7, wherein the bowl has a base and the arc of a circle defining the surface of the edge portion of the air intake confronting the bowl passes through a point on the outer edge of the stiffening ring in facing relation to the base of the bowl.

11. A fan according to claim 7, wherein the bowl has a base and the arc of a circle defining the surface of the edge portion of the air intake confronting the bowl passes through a point on the inner edge of the stiffening ring in facing relation to the base of the bowl.

12. A fan according to claim 7, wherein the arc of a circle defining the surface of the edge portion of the air intake confronting the bowl passes through a point on the inner edge of the stiffening ring in facing relation to the edge portion of the air intake.

13. A fan according to claim 7, wherein the bowl has a base and the housing has inner walls which are parallel to the base of the bowl, each inner wall having a portion of progressively decreasing thickness substantially from the outer edge of the vanes.

14. A fan according to claim 1 wherein the driving means comprises a cylindrical four-pole electric motor whose axial length is less than the diameter of the electric motor.

* * * * *